United States Patent [19]

Cook et al.

[11] Patent Number: 4,598,186

[45] Date of Patent: Jul. 1, 1986

[54] VENT ARRANGEMENT FOR HIGH AMPERAGE MOLDED CASE CIRCUIT BREAKER

[75] Inventors: James W. Cook, Solon; Tery J. Evans, Cedar Rapids, both of Iowa

[73] Assignee: Square D Company, Palatine, Ill.

[21] Appl. No.: 493,112

[22] Filed: May 9, 1983

[51] Int. Cl.[4] ..... H01H 33/08

[52] U.S. Cl. ..... 200/144 R; 200/147 R

[58] Field of Search ..... 200/144 R, 147 R, 148 C

[56] References Cited

U.S. PATENT DOCUMENTS

| | | | |
|---|---|---|---|
| 3,684,849 | 8/1972 | Zubaty | 200/144 R |
| 4,178,618 | 12/1979 | Khalid | 361/58 |
| 4,220,935 | 9/1980 | Wafer et al. | 335/38 |
| 4,229,630 | 10/1980 | Wafer et al. | 200/148 C |
| 4,295,022 | 10/1981 | Robins | 200/147 R |
| 4,375,021 | 2/1983 | Pardini et al. | 200/144 R |
| 4,377,795 | 3/1983 | Schultz et al. | 335/23 |
| 4,393,287 | 7/1983 | Nakano | 200/147 R |

*Primary Examiner*—Robert S. Macon

*Attorney, Agent, or Firm*—Norton Lesser; Mary R. Jankousky; Richard T. Guttman

[57] ABSTRACT

Arc suppressor plates in a high amperage molded case circuit breaker are arranged in an arc corresponding to blade travel and define passageways having larger exits aligned with respective vents defined by a molded insulator engaged in the wall of the circuit breaker base.

9 Claims, 15 Drawing Figures

FIG. 2a
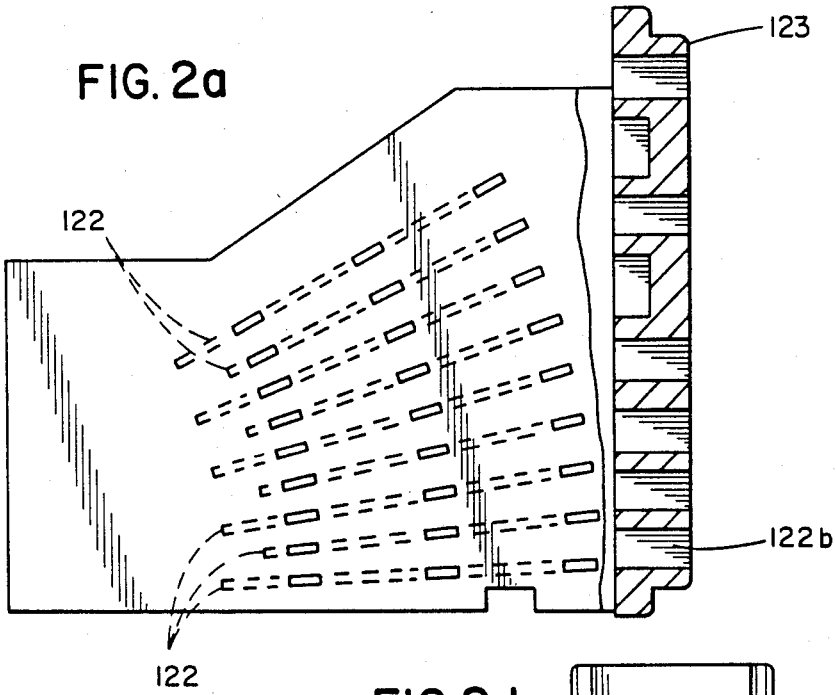
FIG. 2d
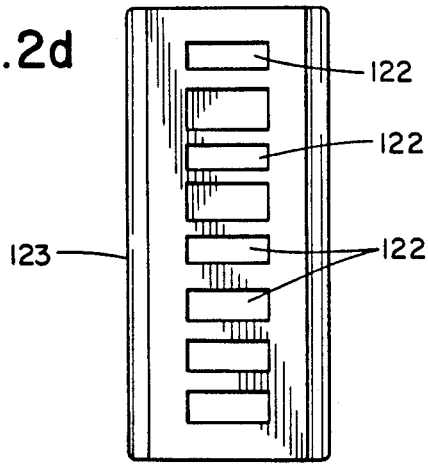
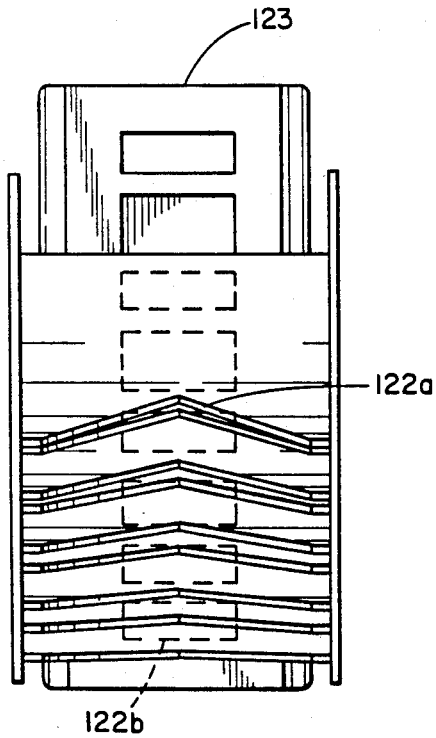
FIG. 2b
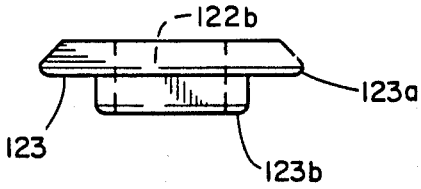
FIG. 2c

VENT ARRANGEMENT FOR HIGH AMPERAGE MOLDED CASE CIRCUIT BREAKER

FIELD OF THE INVENTION

The present invention relates in general to circuit interrupting apparatus and more particularly to an improved and/or more economical arc control and vent arrangement for use in a high amperage molded case circuit breaker.

BACKGROUND OF THE INVENTION

High amperage molded case circuit breakers are required to interrupt large values of current extended through a plurality of downstream breakers to respective loads. Problems of course arise from the blade and contact mass required to carry the large current values and from the necessity to control the high energy arcs created on current interruption. These problems are compounded in high amperage molded case breakers since the size of the apparatus, while large, is substantially reduced from that provided in iron clad or open frame breakers.

Arc plate stacks are also provided to assist movement of the arc from the vicinity of the contacts toward a vent opening in the breaker housing. The vent opening should be designed to provide some back pressure but not excessive back pressure during current interruption in order to prevent the arc from either restarting if it should be blown out too quickly, or to enable the arc to extinguish. The vent opening should therefore be subdivided into a number of passages spaced in correspondence with the movement of the arc. Providing such spaced passages in the molded wall of the breaker housing is difficult as this requires mold parts that move transverse to the mold forming the main housing cavity.

SUMMARY OF THE INVENTION

The present invention provides a high amperage molded case circuit breaker carrying currents in ranges between 800 amps and 3000 amps. The breaker includes a plurality of blades of identical length for each phase and the blades are biased by respective springs into a contact closed condition when the toggle assembly is erected to move the blade carrier for each phase into a contact closed position as explained in applications Ser. No. 492,901 filed simultaneously herewith by Chabot, Chabot and Wong, by Wong and by Cook, whose disclosures are incorporated herein.

The arc suppressor assembly comprises a plurality of stacked arc suppressor plates with alternate plates spaced further from the ends of the steel horns than the other plates to define arc suppressor passageways guiding the arc toward a plurality of spaced vent openings. The vent openings are formed in a separately molded insulator at asymmetrically spaced positions and generally aligned with the arc suppressor passageways when assembled to the breaker base to provide the proper degree of back pressure for aiding in extinguishing the arc. The insulator is nestingly received and retained in a single opening or passage formed with the main cavity in the breaker base wall by means of complimentary ribs and recesses thereby providing a relatively simple and economical arrangement of arc suppressor passages in the molded base of a high amperage molded case circuit breaker.

It is therefore an object of the present invention to provide an improved and more economical molded case circuit breaker of the type utilized for interrupting high currents.

Other objects and features of the present invention will become apparent on examination of the following specification and claims together with the accompanying drawings.

BRIEF DESCRIPTION OF THE DRAWINGS

FIG. 2*a* is a side elevational view of the arc suppressor assembly and vent member.

FIG. 2*b* is a front elevational view of the arc suppressor assembly and vent member.

FIGS. 2*c* and 2*d* are respective top and front elevational views of the molded vent member for the arc suppressor assembly.

GENERAL ORGANIZATION OF THE CIRCUIT BREAKER

Figure 1:
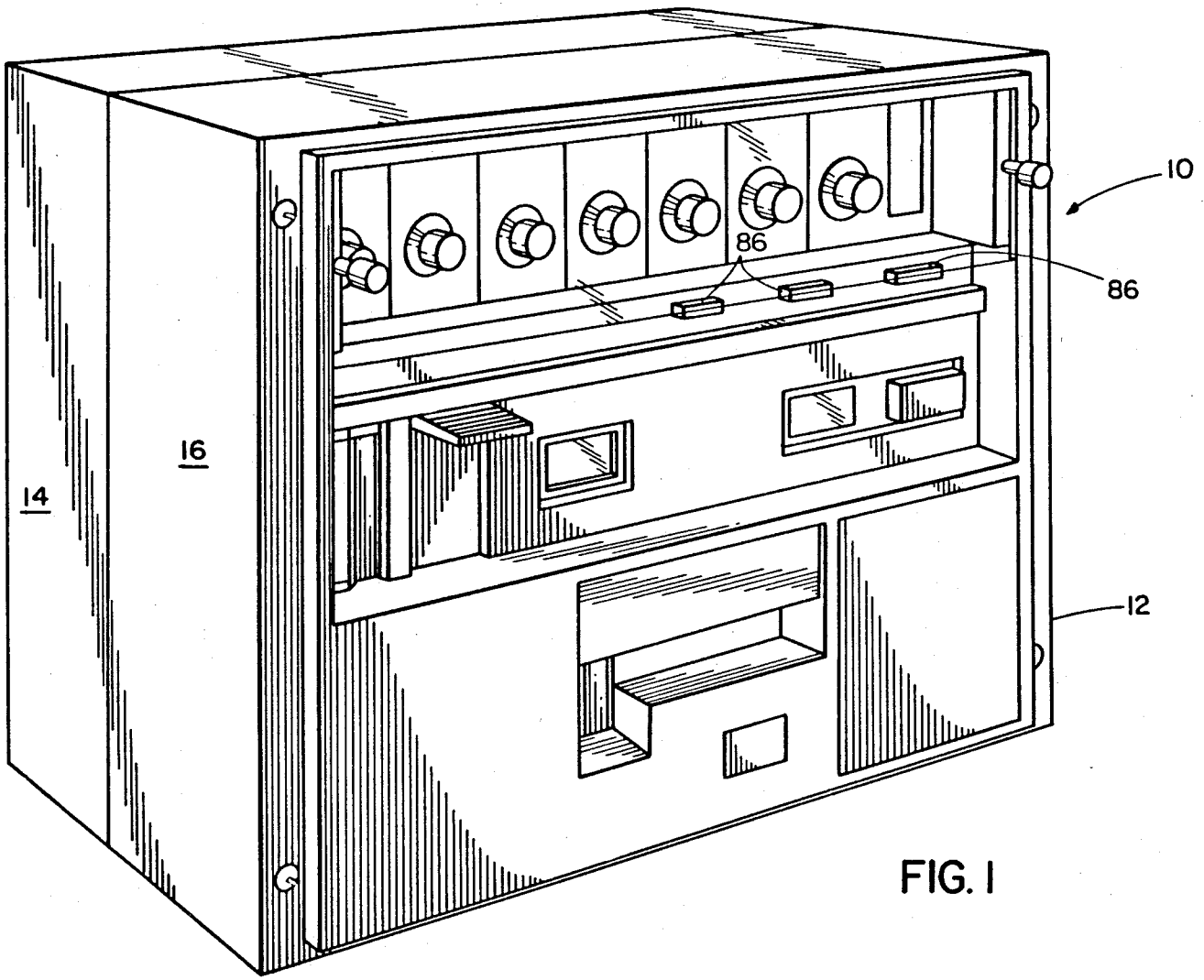
FIG. 1 is a isometric view of a three phase molded case circuit breaker incorporating the principles of the present invention.

A three phase molded case circuit breaker is indicated is FIG. 1 by the reference character 10. The circuit breaker 10 is rated to carry current in selected ranges, for example, between 800–1600 or between 1600 to 3000 amps dependent on the choice of components. The breaker 10 includes a housing 12 having a base 14 and a cover 16 and is adapted to interrupt 85 KA at 600 volts or for example 100 to 150 KA at 480 volts dependent primarily on the choice of material and the number of contacts provided.

The housing 12 has dimensions of only 15½" by 15" by 13" for a breaker carrying currents in the maximum ranges and while a smaller housing and/or some apparatus in the breaker may be altered dependent on the desired functions or current carrying capacity, the apparatus for accomplishing the inventive functions desired in breakers carrying currents in the higher values of the above noted ranges will be described below.

Figure 2:
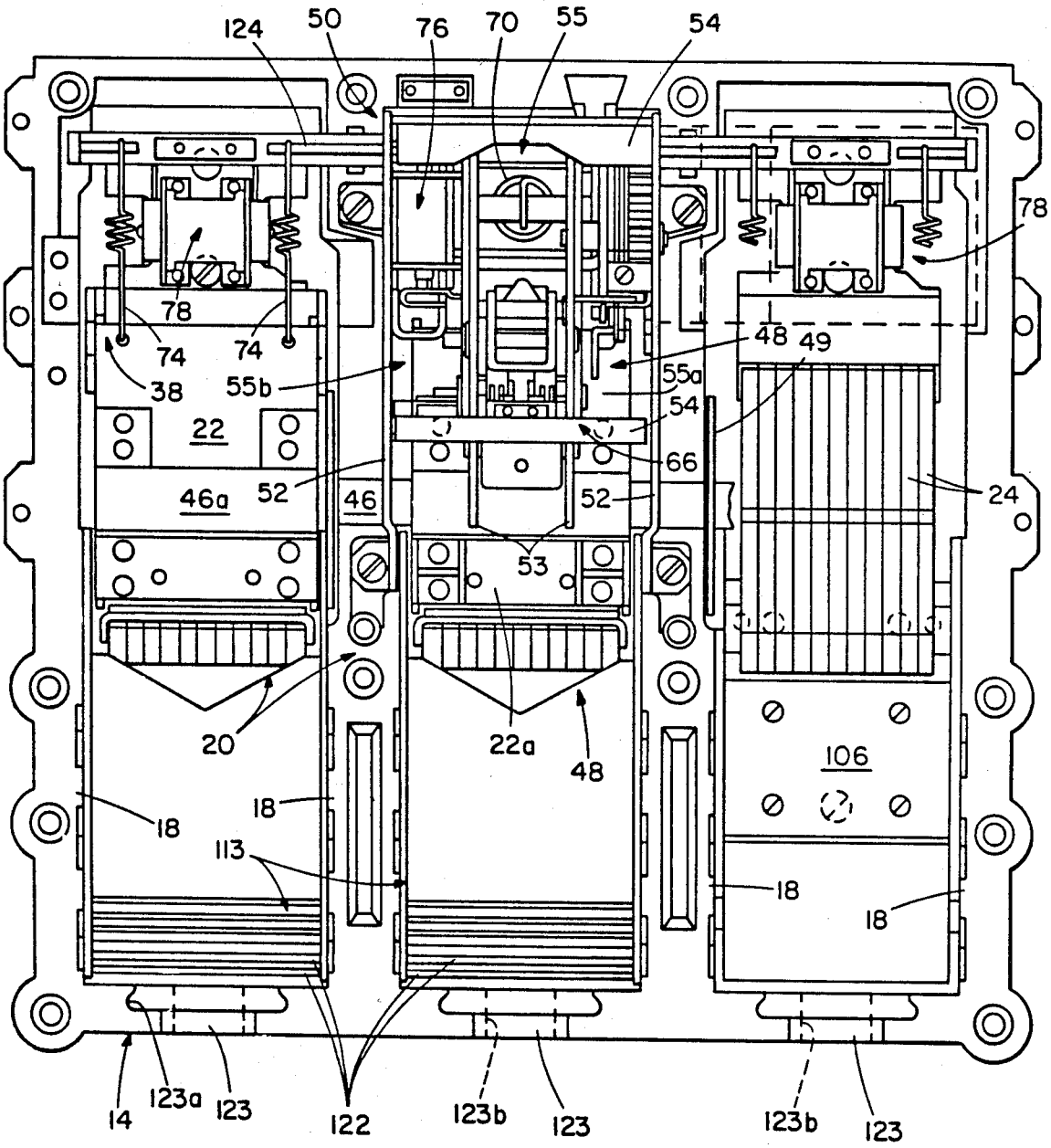
FIG. 2 is a top elevational view of the molded case circuit breaker shown in FIG. 1 with the cover and other assemblies omitted.
Figure 3:
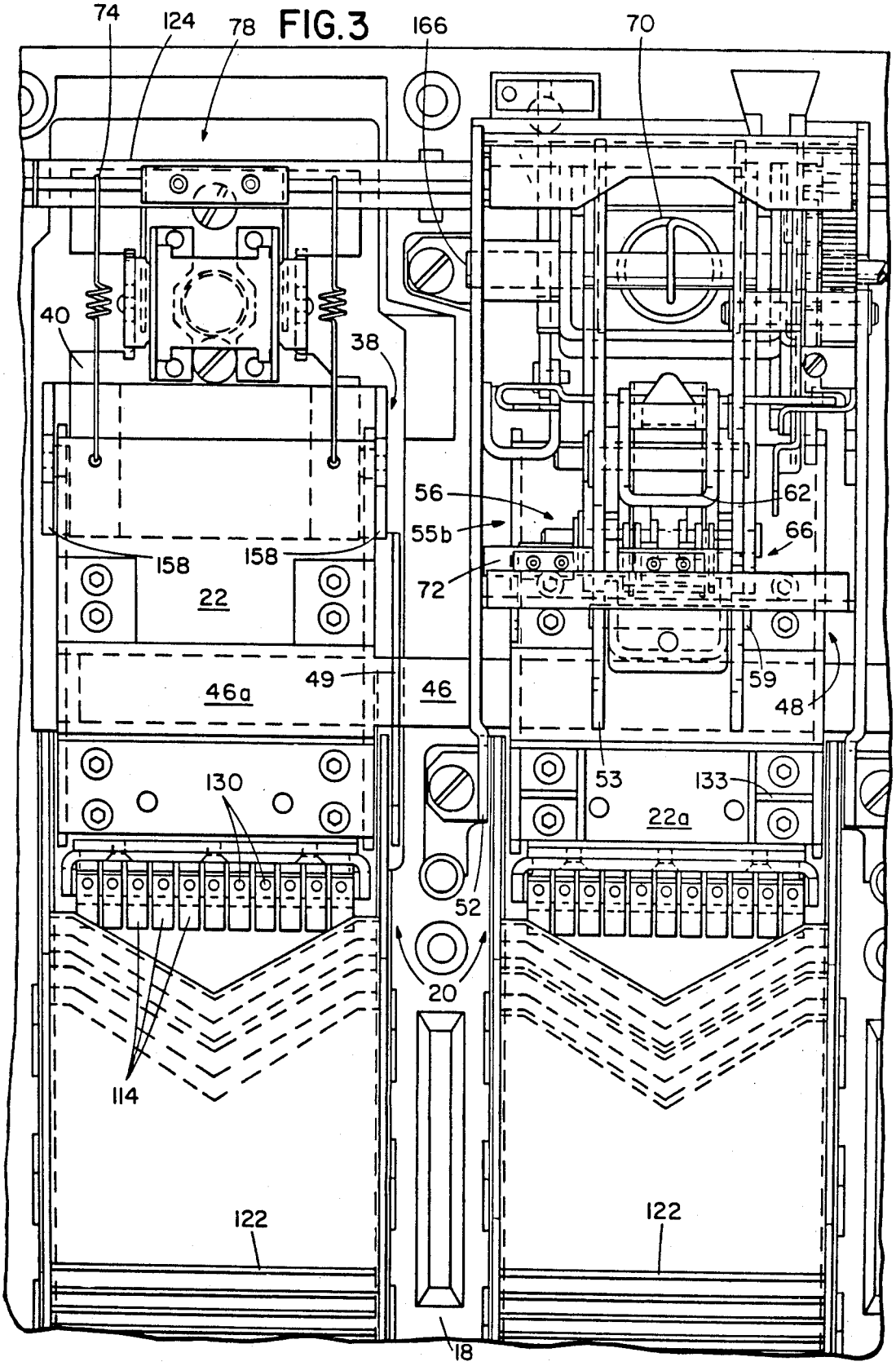
FIG. 3 is an enlarged view similar to FIG. 2 showing the center and one side compartment of the breaker, but omitting the trip solenoid and other assemblies.
Figure 3A:
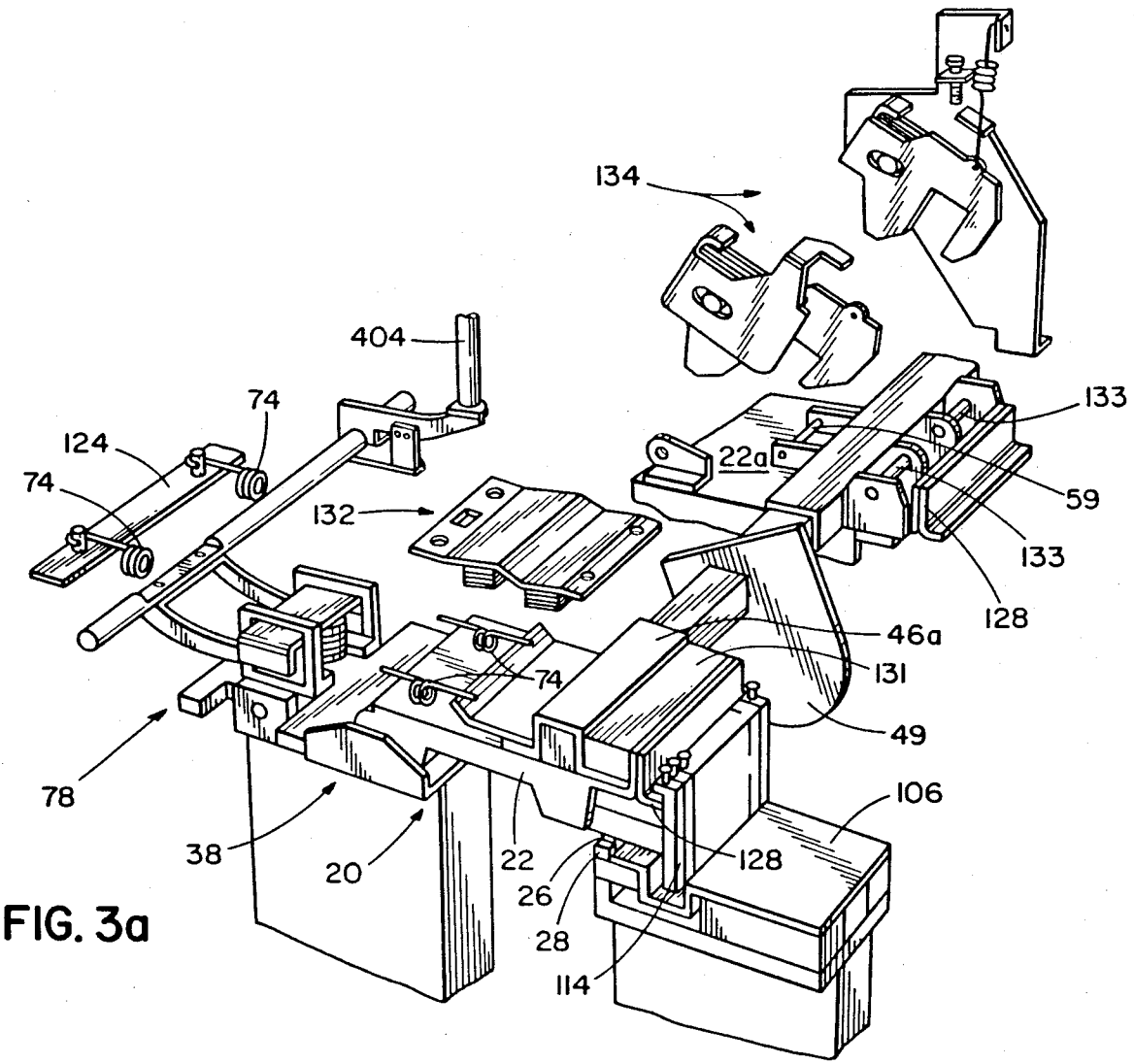
FIG. 3*a* is an exploded view illustrating the cooperation of the blade carriers with the stop shock and catcher assemblies.

The base 14 as seen in FIGS. 2 and 3 includes insulating side and intermediate walls 18 engaged with similar walls of the cover 16 to form a compartment for each phase. A blade assembly 20 is located in each compartment.

Figure 4:
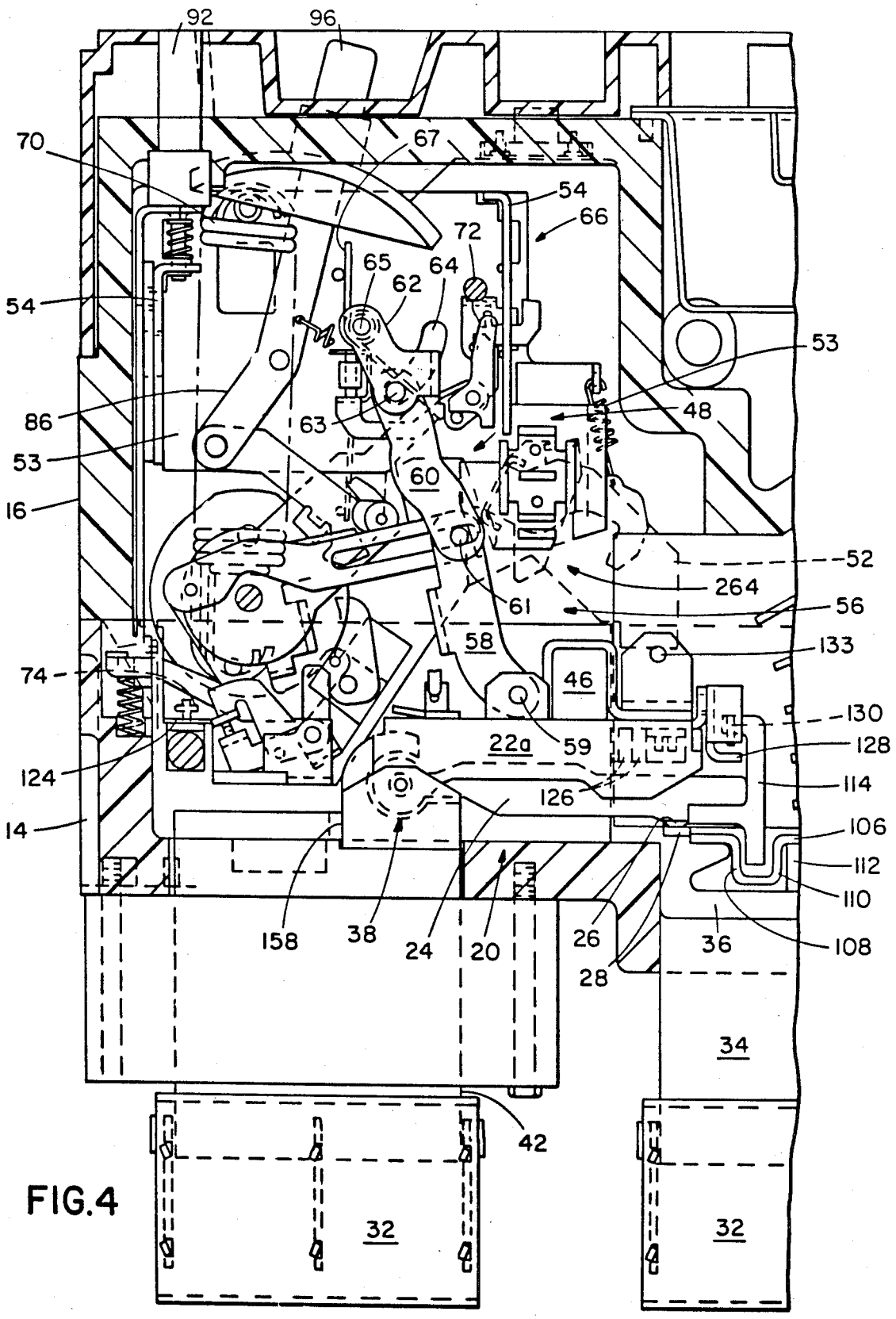
FIG. 4 is a side elevational view of the breaker center compartment taken to generally illustrate the operating and charging assemblies with one wall of the breaker frame assembly and certain control assemblies omitted.
Figure 5:
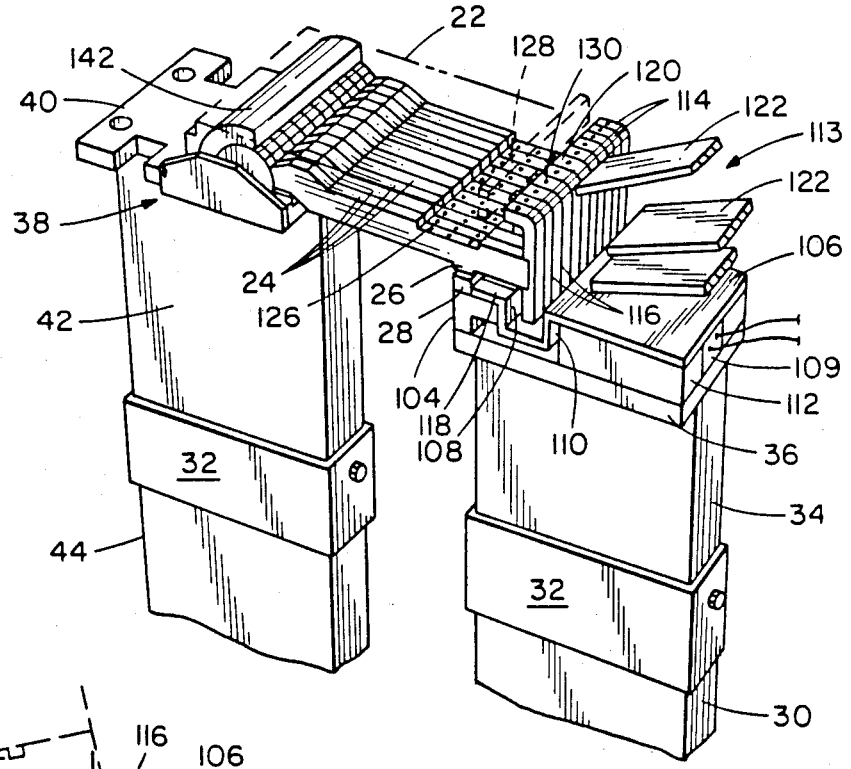
FIG. 5 is a generally isometric view of one blade and pivot assembly with the blade carrier indicated only in part by dashed lines.

The blade assemblies 20 in the side compartments each include a blade carrier 22 and in the center compartment a blade carrier 22*a* is provided with each blade carrier overlapping a plurality of silver plated copper blades 24. Each blade carries a movable contact 26 adjacent one blade end adapted to engage a respective stationary contact 28 as best seen in FIGS. 4, 5 and 5*b*.

The contacts 26 and 28, when engaged, extend a circuit from a respective line bus bar 30, connected through a respective jaw connector assembly 32, line terminal 34 and line conductor 36 to contacts 26 and 28, through a respective copper blade 24, pivot assembly 38, load conductor 40, load terminal 42 and a respective jaw connector assembly 32 to a load bus bar 44. The line and load terminals 34 and 42 project from the bottom wall of the base and each carries the respective connector assembly 32 with some pivotal movement to permit facile alignments of the connector assemblies with the respective bus bars.

The blade assemblies 20 each are interconnected by an electrically insulating blade crossbar 46 secured to the top surface of each blade carrier 22 and 22*a* by means of a respective U-shaped bracket 46*a* for simultaneous movement about the axis provided by pivot assembly 38 under control of an operating assembly 48. Insulating barriers 49 are carried by the blade crossbar 46 to prevent arcing between the breaker compartments.

The operating assembly 48 is supported in a metal frame 50 located in the center compartment of the breaker and secured to the base 14 with the frame 50 including outer side walls 52, intermediate walls 53 together with front and rear end walls 54. Bent tabs on the end walls 54 projecting through the outer side walls 52 and bent tabs on the intermediate walls 53 projecting through the end walls 54 secure the walls to each other in a box like structure having a center frame compartment 55 and side frame compartments 55*a* and 55*b*.

Assembly 48 includes a toggle assembly 56 located in compartment 55 having a U-shaped lower link 58 whose lower end is pivotally interconnected to the carrier 22*a* by a pin 59, as probably best seen in FIG. 4. The upper end of the lower link 58 is connected to the bottom end of a pair of aligned upper links 60 by a follower pin 61 located below the intermediate walls 53 and projecting into compartment 55*b*. The upper end of link 60 is pivotally connected to the lower end of a U-shaped latch link 62 by a pin 63 adapted to move in arcuate slots 64 formed in each of the intermediate walls 53.

Slots 64 extend upwardly and forwardly in walls 53 toward a latch assembly 66 adapted to latch the link 62 for enabling links 58 and 60 to be placed in their erected or aligned position for closing contacts 26 and 28.

The upper end of latch link 62 is pivotally supported between the intermediate frame members 53 by a pin 65 and a torsion spring 67 wrapped about pin 65 biases pin 63 toward the bottom end of slots 64 for enabling the latch assembly 66 to latch the latch link 62. With the link 62 latched, the toggle assembly 56 is erected under control of a charge and crank assembly 68 carried by the frame 50 and having a closing spring 70 located in frame compartment 55. The discharge or release of spring 70 erects the toggle links 58 and 60 to close contacts 26 and 28.

The latch assembly 66 best seen in FIG. 3 is operated by a trip shaft 72 to release link 62, which can then pivot counterclockwise about the axis of pin 65 as seen in FIG. 4 while pin 63 moves in slots 64 under the influence of opening springs 74. The opening springs 74 are located in the breaker side compartments and initially pivot the blade carriers 22 to open contacts 26 and 28 and collapse the toggle assembly 56 when the latch assembly 66 initially disengages from the latch link 62.

Trip shaft 72 is under control of a trip solenoid assembly 76 best seen in FIG. 2. Assembly 76 is supported on one of the side walls 53 in a side compartment 55*b* of the frame 50. A magnetic assembly 78 seen, for example, in FIGS. 2 and 3 supported on respective load conductors 40 is located in each compartment of the breaker to also control the latch assembly 66 to enable collapse of the toggle assembly 56 for opening the contacts 26 and 28. In addition a push to trip or open link 80 permits the trip shaft 72 to be manually operated for opening the contacts 26 and 28.

The cover 16 supports electronic circuitry of the type described in copending applications by Zylstra; by Zylstra and Venzke and by Zylstra and Jansen filed simultaneously herewith.

The operation of the circuit breaker is described in greater detail in the patent applications previously incorporated by reference. It is sufficient herein to understand that in interrupting a current the circuit breaker causes the contacts 26 and 28 to be separated by pivoting the blade carriers 22.

DETAILED DESCRIPTION OF THE CIRCUIT BREAKER BLADE ASSEMBLIES

Each blade assembly 20 as mentioned is adapted to extend a circuit from a respective line conductor 36 formed of silver plated copper. Each line conductor is secured to and extends transverse to the longitudinal axis of the respective line terminal 34 as best seen in FIG. 5.

An upstanding end leg 104 is formed on one end of each conductor 36 to support a plurality of stationary contacts 28 for each phase in aligned fixed positions. A recess or cavity is formed behind the leg 104 and intermediate the ends of the conductor 36 to receive U-shaped iron or steel arc runner or plate 106 with the side legs 108 and 110 of the U-shape defining a recess. A temperature sensor or bimetal switch 109 of conventional design may be secured to the conductor 36 adjacent the contacts 26 and 28 to sense the heat generated in the conductor and contacts for enabling an overheated condition to be determined for operating a respective one of the indicators 86, as explained in the aforementioned Zylstra application.

Plate 106 has an arc runner arm extending from side leg 108 to a position adjacent the contacts 28 in overlapping engagement with a rearwardly extending projection on leg 104 and another arc runner arm extending from leg 110 overlaps and engages with a pair of spaced insulating blocks 112 located on conductor 36 to fixedly support the arc runner 106 on the line conductor 36 with the back leg of the U-shape spaced from conductor 36. The arc runner arm extending from side leg 110 is in turn overlapped by an arc suppressor assembly 113. The arc runner arm extending from leg 108 is in turn overlapped, but spaced from an end portion of copper blade 24, which extends beyond the respective contact 26.

The blades 24 are of identical length to facilitate manufacture and the end portion of each blade overlapping the arc runner has a generally T-shaped steel horn or bar means 114 secured to the end thereof. Each horn 114 has a bar portion or crossbar 116 overlapping the blade end as also seen in FIGS. 5*a* and 5*b* with a downwardly extending portion of the crossbar received between the runner legs 108 and 110 of the runner 106 and relatively close to leg 108 when the contacts 26 and 28 are closed. Each horn 114 includes a leg 118 overlapped by the end portion of the respective blade 24 and spaced from the runner arm extending from leg 108 toward the respective contacts 28. Leg 118 extends to a position adjacent the respective contact 26 to protect the extending portion of the blade end and to aid in securing the horn thereto.

Another portion of the crossbar 116 extends to a position above the respective blade 24 and has a rearwardly extending leg 120, which overlaps but is spaced from the respective blade 24.

The arc suppressor assembly 113 comprises an stack of spaced arc suppressor plates 122 located between side insulating runners each having locating tabs for proper positioning in a respective breaker compartment adjacent the blade ends. The front edge of each plate 122 lies in a path close to the path of horn movement and a V-shaped notch 122*a* is formed in the edge of each plate facing the respective horns. Alternate plates 122 are positioned further from the blade ends than the other plates or staggered as shown in FIG. 2*a*. The arc plate stack thus forms a series of arc suppressor passages each positioned to pass the arc as the blades move in an upward arcuate path with the passages having exit openings that are wider or larger than the entrance openings and assist movement of the arc from the horns and dissipation of the arc gases through a plurality of vents 122*b*. Vents 122*b* are formed by a molded vent insulator member 123 placed in an opening located in the rear wall of the base 14 adjacent the ends of plates 122 as seen in FIG. 2.

The use of the molded insulator 123 is a very economical device for providing vents or openings of the proper size and spacing, since the vents do not have to be molded in the wall of the base, which would require mold inserts transverse to the mold cavity. Instead the vents 122*b* are molded into the insert or insulator 123 and the insulator simply inserted in the base opening.

Thus if a single large vent is provided not enough back pressure is created to extinguish the arc, while a small vent creates too much back pressure. It is desirable to provide a plurality of spaced vents 122*b* substantially $\frac{3}{4}''$ wide and $\frac{3}{8}''$ high aligned with respective ones of the arc suppressor passages defined by the spaced plates 122. Adjacent the lower end of the arc plate stack, this arrangement introduces enough vents during initiation of the arc when its pressure is high to prevent damage while the number of vents adjacent the top of the stack is smaller and are spaced apart by solid wall sections of greater height dimension than the vents to maintain a desired back pressure as the arc starts to extinguish. This type of venting arrangement for reasons mentioned is difficult and expensive to provide in the base wall and therefore the insulator 123 which is provided with a pair of side ribs 123*a* and a polarizing back wall 123*b* for engaging correspondingly shaped and positioned surface of the base opening is easily assembled in proper relationship to the stack and thereafter overlapped by the cover.

Figure 5E:
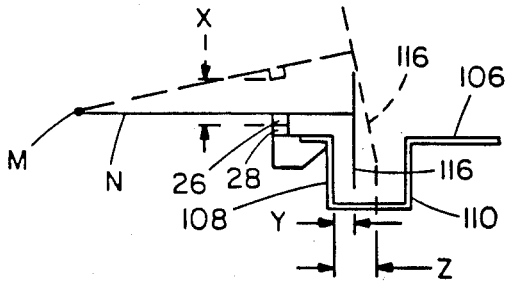
FIG. 5*e* is a schematic view illustrating the manner in which the arc is transferred.

The blades 24 are pivotably supported adjacent their ends opposite horns 114 by pivot assembly 38 for pivoting movement about axis M as indicated by the schematic diagram in FIG. 5*e*. When the blades pivot about axis M to separate the contacts 26 and 28 the horn crossbar 116 travels relatively close to the arc runner leg 108, as the lowest end of the crossbar moves toward the radial line N extending from the pivot axis M to contact 26, while the contacts 26 and 28 separate by an ever increasing distance noted at X. The crossbar 116 between legs 108 and 110 of the arc runner thus moves along a path generally parallel to leg 108 which extends transverse to the radial line N. Therefore as the gap between the contacts 26 and 28 increases to the distance X, the gap distance Y between the bar 116 and leg 108 increases at a slower rate than the distance X and traverses the distance Z at which the horn 116 moves to a position adjacent side leg 110 of the arc runner.

The distance X therefore becomes rapidly greater than the distance Y and when the resistance in the arc increases to a value where the path between leg 108 and bar 116 offers less resistance, the arc transfers and extends between leg 108 and the horn bar 116. This occurs a short time after the contacts 26 and 28 open. As the blades 24 continue to pivot the horn bar 116, bar 116 approaches the distance Z, placing bar 116 close to leg 110 which also extends transverse to radial line N. The arc now transfers to the leg 110 and the current passes through the relatively high resistance steel arc runner plate 106. Thereafter as the horn bar 116 moves from between legs 108 and 110, the gap increases to increase the arc resistance and with the high resistance of the steel in the circuit, the arc is faciley extinguished. As often happens the arc may initially extend between bar 116 and leg 110. In either event the arc is quickly blown or magnetically forced to leg 110. The transfer of the arc to the steel runner 106 avoids damage or erosion of the contacts and protects the conductor 36 as the high resistance steel of the horn and runner are inserted in the circuit a relatively short time after the contacts open.

The carriers 22 for the blade assemblies 20 located in the side compartments of the breaker are attached to one end of opening springs 74 whose other ends are held by respective pins mounted on an insert member 124 adjacent the magnetic assemblies 78. When the latch link 62 is released by the latch assembly 66, the springs 74 pivot the carriers 22 in the breaker side compartments and the carrier 22*a* in the center compartment through crossbar 46 about axis M to initiate collapse of the toggle assembly 56. The carriers 22 are generally U-shaped and the back wall overlaps the respective blades and the pivot assembly 38, which is located between the side legs of each carrier 22 and 22*a* at the end of each carrier 22 and 22*a* opposite horns 114.

A plurality of helical or coil overtravel springs 126 for each blade 24 are captured between each blade top surface and the back wall of the respective carrier 22 or 22*a*. Overtravel springs 126 bias the respective carrier 22 or 22*a* counterclockwise relative the blades 24 as seen in FIGS. 4, 5 and 5*b* to facilitate movement of the carrier and collapse of the toggle assembly 56 when the latch assembly 66 is released and their force requires that closing spring 70 supply considerable energy to close the contacts.

An L-shaped end adjustment leg or flange 128 is secured to each carrier 22 and 22*a* adjacent horns 114 and extends to a position between the ends of blades 24 and the upper legs 120 of the horns 114. Flanges 128 are engaged by an adjustment member screw 130 when the respective carrier is pivoted by the opening springs 74. The screws 130 are threaded through respective horn legs 120 to select the distance travelled by the carrier 22 or 22*a* before an opening force is applied to the respective blades 24 to rapidly open the respective contacts 26 and 28.

Thus eleven blades 24 are usually provided in each breaker compartment to carry the current loads of the larger magnitudes described and the center group of blades in each compartment are provided with arc resistant contacts intended to carry arcing current while eight outer blades carry low resistance contacts.

By adjusting the gap between screws 130 of the outer blades so that they are first engaged by the carrier 22 or 22*a* under normal overload conditions, their contacts open, while the contacts on the center blades are still closed. This avoids arcing between contacts 26 and 28 of the outer group of blades as the center group are still carrying the current. The blades in the center group then open their contacts, as carrier travel continues for engaging the respective screws 130. The blades in the center then open their contacts. At that time some arcing may occur before the arc transfers to the horn crossbars 116 as already explained, but this arc is minimal as the contacts of the center group need only separate approximately 0.1" before arc transfer occurs.

The inverted U-shaped member or bracket 46*a* is secured each carrier back wall for securing the noncircular blade crossbar 46 interconnecting the blade assemblies 20 for simultaneous movement. The U-shaped member 46*a* on carriers 22 and a aluminum block 131 secured to the carriers 22 in the side compartments are adapted to be engaged by respective stop and shock absorber assemblies 132 carried by a wall of the cover 16 in the respective side compartments while a pair of short pins 133 secured to flanges on the back wall of carrier 22*a* in the center compartment are adapted to be engaged by a respective one of a pair of catcher assemblies 134, when the contacts 26 and 28 are opened in response to tripping of the breaker.

Blade Pivot Assembly

Figure 5D:
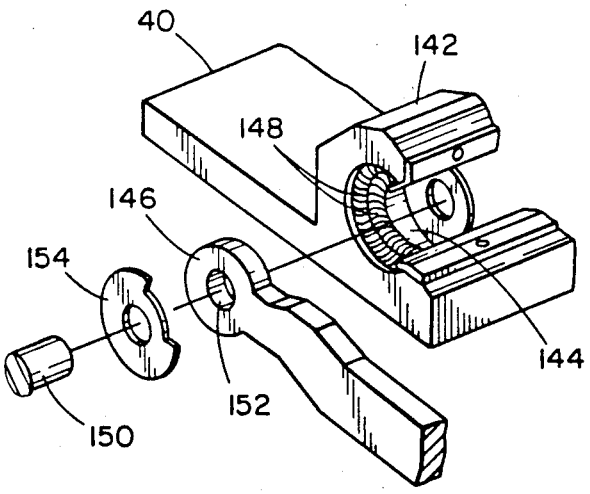
FIG. 5*d* is an isometric view illustrating a portion of the pivot assembly.
Figure 5A:
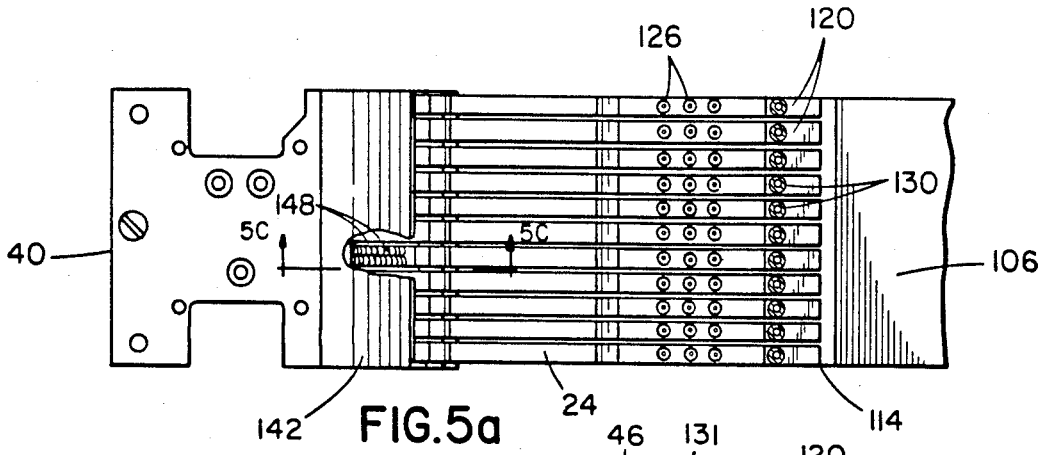
FIG. 5*a* is a top elevational view of the blades and the pivot assembly shown in FIG. 5.
Figure 5B:
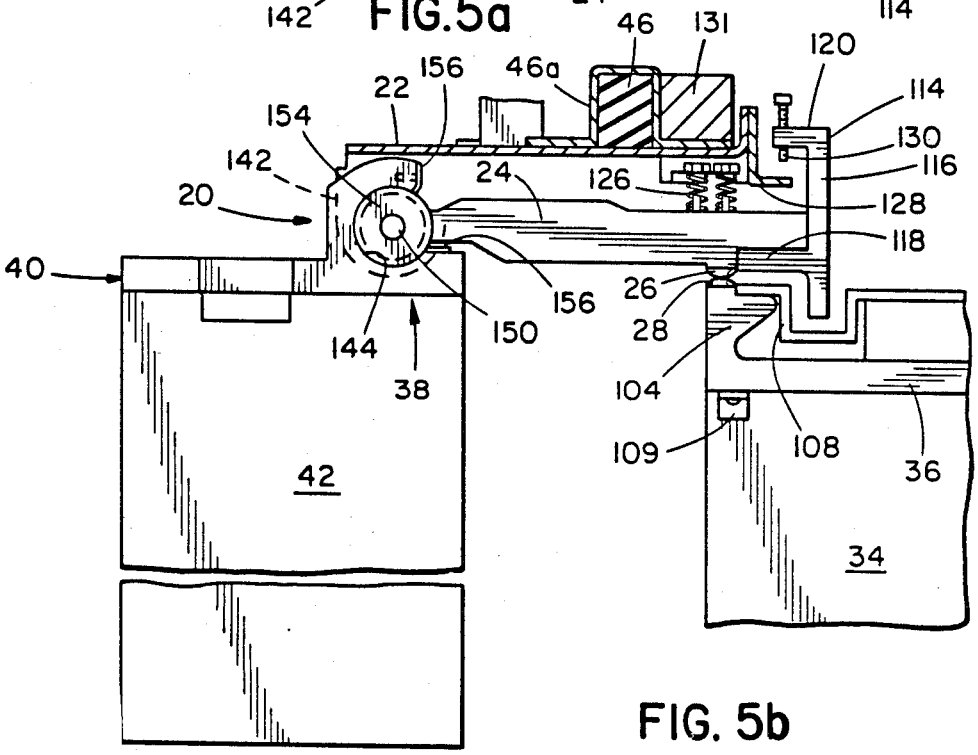
FIG. 5*b* is a side elevational view of the blades shown in FIG. 5 and illustrating a portion of associated carrier.
Figure 5C:
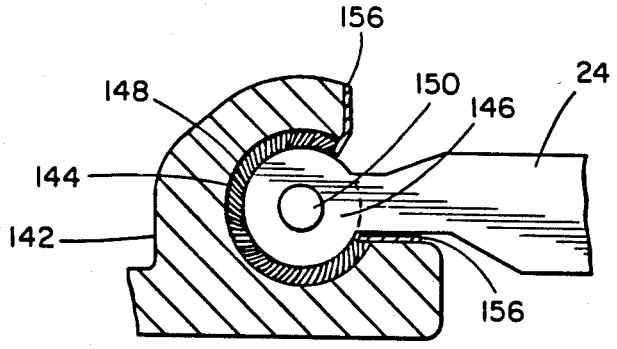
FIG. 5*c* is a sectional view taken generally along the line 5*c*—5*c* in FIG. 5*a* to more clearly illustrate the pivot assembly.
Figure 6:
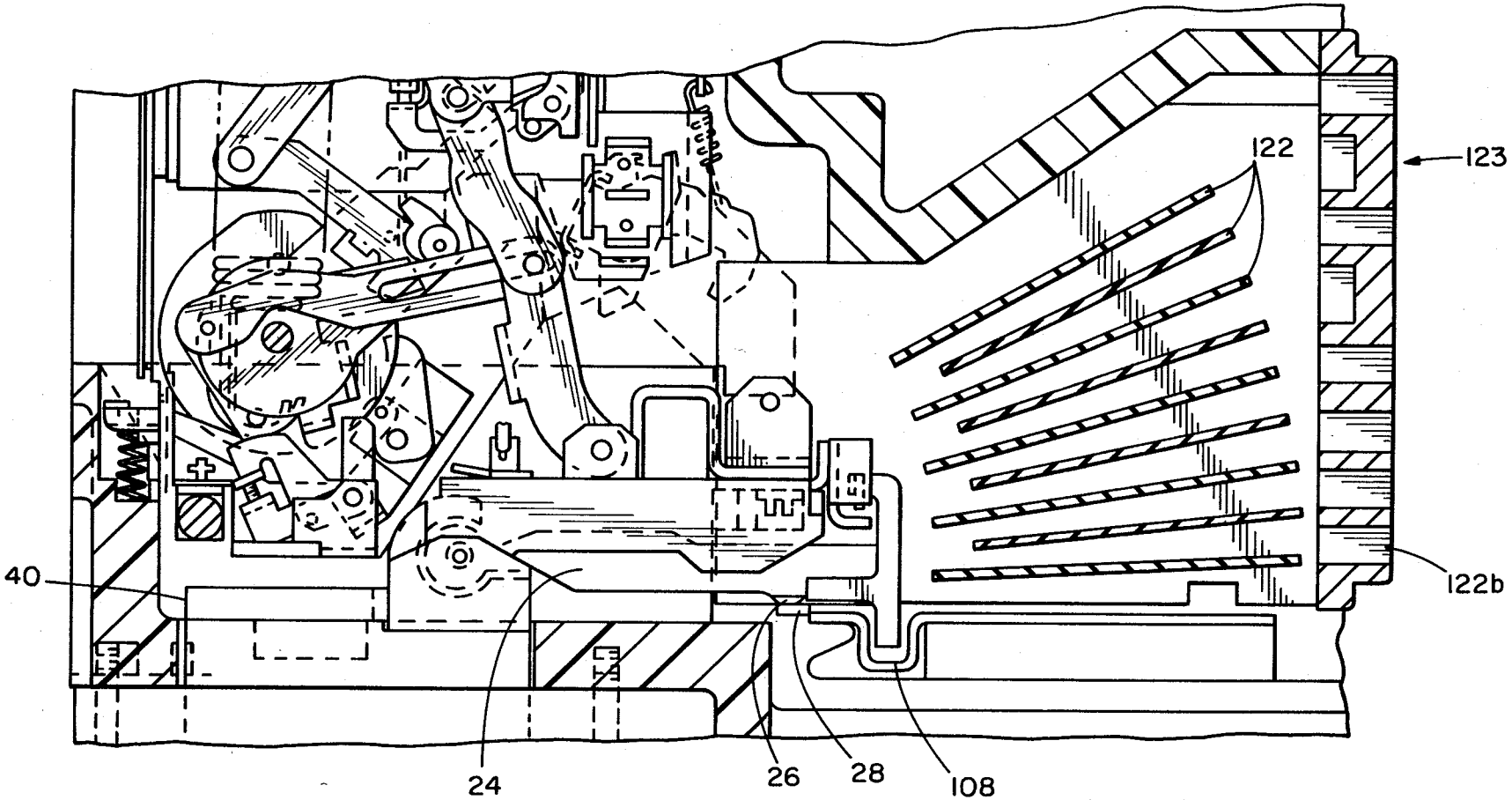

Each pivot assembly 38 located between the side legs of the respective carrier 22 and 22*a* comprises an arcuate bearing boss 142 located adjacent one end of the load conductor 40 and having an arcuate recessed bearing surface 144 extending over 180° to receive an arcuate or circularly shaped boss 146 at the end of each blade 24 opposite the horns 114 as best seen in FIGS. 5*b*, 5*c* and 5*d*.

Boss 146 has a somewhat smaller diameter than surface 144 and may be out of round by as much as 0.006". A pair of helical diameter coil springs 148 having an outer diameter of substantially 0.120" formed of 0.016" diameter silver plated copper cadmium alloy wire having a conductivity of 85% of pure copper and resilient at a continuous temperature 130° C. are interposed between each blade circular boss 146 and the arcuate or circular bearing surface 144 and accommodate any eccentricity of the blade bosses.

The difference in the diameter between the blade circular boss 146 and the arcuate bearing surface 144 is smaller than the outer diameter or OD of the springs 148 and is chosen so that each spring turn lies at angle of substantially 45° to the longitudinal axis of the spring with the longitudinal axis extending parallel to the arcuate surface of the blade boss 146. The chosen angle is a function of the difference in diameter between the surface 142 and bosses 146 and the spring diameter and serves to accommodate the eccentricity of the blade bosses without binding. Thus wrapping the springs 148 about each blade boss 146 provides multiple points of electrical contact between each blade 24 and the conductor 40 through the bearing boss 142. In addition the springs 148 are coated with a silicone grease sold by General Electric under the name Versalube G341 M. It will be noted that the spring turns of each pair of springs 148 engaged with any one boss 146 extend in transverse directions or at 90° to each other as seen in FIG. 5*a* so that the effect of pivoting movement by the boss in any one direction is compensated.

A rod 150 extends through an aligned aperture 152 in each circular boss 146 and an aligned aperture in a plurality of spaced washers 154 each located between respective blade bosses 146. The washers 154 each have a diameter larger than the respective blade boss 146 and serve to restrain axial movement of the springs 148. A respective sheet metal retaining member 156 is fastened to the bearing boss 142 adjacent each end of surface 144 and each member 156 has an edge projecting past the respective end of surface 144 to restrain circular movement of the springs about the pivot axis M formed by rod 150, which primarily carries the weight of the blades.

In addition a portion of the circumference of the washers 154 is notched to provide spaced shoulders engaging each restraint member 156 and the bearing boss 142 is slightly deformed at opposite ends to restrain axial movement of the washers, springs and blades. The rod 150 forms the pivot axis M for the carriers 22 and 22*a* and end walls or brackets 158 on conductor 40 traps the rod which carries the weight of the blade bosses. Thus the pivot assembly 38 presents an economical arrangement for carrying high electrical currents around a pivot connection, since the blade bosses 146 together with springs 148 may easily be inserted axially in boss 142 with the washers 154 between adjacent springs 148. Thereafter the blades 24 and springs 148 are supported in the boss 142 with the springs providing multiple points of electrical conductivity to minimize heat rise in the breaker and aid in maintaining high current withstand of the breaker.

Since the opening of the contacts 26 and 28 by engagement of carrier flange 128 with screws 130 during overload conditions occurs with minimum frictional loads, movement is initiated relatively easily as minimum back pressure is applied to resist springs 126, and in the event of short circuit currents, when opening forces are high, movement of all blades will occur substantially simultaneously with engagement of the flange 128 by the respective screws 130.

What we claim is:

1. In a multiphase molded case circuit breaker including a plurality of contact blades for each phase arranged to carry alternating current in a selected range between 800 and 3000 amperes, with each blade carrying a blade contact intermediate the ends of the respective blade and having a respective carrier for each phase adapted to pivot a free end of the respective blades in one direction about a blade pivot axis for engaging a respective stationary contact to establish a connection between a line conductor and a load conductor for each phase with each contact adapted to generate an arc in response to pivot movement of the respective carrier and the respective blades in the opposite direction during current interruption under the influence of respective overtravel springs located between each carrier and the respective blades, the improvement comprising:

a molded base formed of insulating material for carrying said line and load conductors with said base having an opening formed therein for each phase with each opening spaced from the free ends of the respective blades and from the contacts of the respective phase, an arc plate stack for each phase comprising a plurality of spaced apart runners located between a respective opening and the free ends of the respective blades and defining stacked arc suppressor passages extending transverse to the path of the free ends of said blades during pivot movement in said opposite direction for transmitting an arc in the direction of the respective opening, and a molded member of insulating material for each phase having a plurality of passages in asymmetrically spaced apart positions located in each base opening to control the pressure generated during an arc for facilitating extinction of the arc.

2. In the circuit breaker claimed in claim 1 integrally formed complimentary means and on each member and base for retaining each member in a respective opening.

3. The circuit breaker claimed in claim 2 in which said plurality of plates define stacked arc suppressor passageways having openings adjacent the free ends of the respective blades and widened openings adjacent respective ones of said asymmetrically spaced passages.

4. The improvement claimed in claim 3 in which alternate ones of said plates have a leading edge spaced closer to the respective free ends than the immediately adjacent plate.

5. The improvement claimed in claim 4 in which the leading edge of the alternate ones of said plate are arranged in an arc generally parallel to the path of said free ends.

6. In the circuit breaker claimed in claim 5, bar means on each blade adjacent the free end of each blade and having a bar portion overlapping the respective blade, a carrier portion on each carrier located between each respective bar portion and the respective blades, and a respective adjustment member adjustably passing through each bar portion overlapping the respective blade for engagement by the respective carrier portion in response to pivoting of the respective carrier a respective predetermined distance in said opposite direction whereafter the respective adjustment member and bar means are pivoted in said opposite direction to pivot the respective blade in said opposite direction for separating the respective contacts whereby the adjustment of each member controls the sequence in which the respective contacts of each phase open relative the other contacts of the respective phase to in turn select the last contacts to open and generate said arc during current interruption.

7. In a multiphase circuit breaker including a plurality of contact blades for each phase arranged to carry alternating current in a selected ranges between 800 and 3000 amperes, with each blade carrying a blade contact and adapted to pivot in one direction about a blade pivot axis for engaging a respective stationary contact carried on one conductor to establish a connection between a line conductor and a load conductor for each phase with each contact adapted to generate an arc in response to pivot movement of said blades in the opposite direction to separate the respective blade and stationary contacts during a fault current, the improvement comprising:

a molded base formed of insulating material for carrying said conductors with said base having a slot formed therein for each phase with each slot spaced from the free ends of the blades and from the contacts of the respective phase and having one end extending to the upper margin of said base, a molded cover formed of insulating material and adapted to engage the upper margin of said base and close the one end of said slot, a molded member of insulating material having a plurality of passages in asymmetrically spaced apart positions located in each base opening to control the pressure generated during an arc for facilitating extinction of the arc, and integrally formed complimentary means on said member and base for retaining said member in said slot against movement transverse to said one end.

8. An automatic circuit breaker comprising:

a first terminal;

a second terminal;

a molded base having an opening for venting gases;

a pair of separable contacts carried in said base intermediate said first terminal and said second terminal, including a first contact and a second movable contact;

a blade having a free end and a pivot end, said free end carrying said second contact and blade movable between a first position in which said contacts are closed and a second position in which said contacts are open;

an arc plate stack located between said second contact and the opening, said arc plate stack comprising a plurality of spaced apart arc plates positioned transverse to the path of the blade free end, said arc plates each having a first end adjacent said blade free end and a second end positioned adjacent the opening, said arc plates being positioned closer to one another at the first end than at the second end; and a molded member of insulating material positioned within the opening, said molded member having a plurality of passages allowing gas to pass between the inside of the base the area outside the base, the passage being spaced closest together at that portion of the molded member adjacent the separable contacts in the closed position.

9. An automatic circuit breaker as claimed in claim 8 wherein the first end of each arc plate is equidistant from a given point in the circuit breaker.

* * * * *